United States Patent [19]

Iguchi

[11] Patent Number: 5,061,835

[45] Date of Patent: Oct. 29, 1991

[54] LOW-FREQUENCY ELECTROMAGNETIC INDUCTION HEATER

[75] Inventor: Atsushi Iguchi, Kyoto, Japan

[73] Assignee: Nikko Corporation Ltd., Kyoto, Japan

[21] Appl. No.: 480,489

[22] Filed: Feb. 16, 1990

[30] Foreign Application Priority Data

Feb. 17, 1989 [JP] Japan ..... 1-37536

[51] Int. Cl.[5] ..... H05B 6/36

[52] U.S. Cl. ..... 219/10.79; 219/10.491; 219/10.75; 336/96

[58] Field of Search ..... 219/10.79, 10.75, 10.491, 219/10.51, 10.67, 10.493; 336/90, 96, 219

[56] References Cited

U.S. PATENT DOCUMENTS 3,440,384 4/1969 Schroeder ..... 219/10.51
4,136,276 1/1979 Ashe ..... 219/10.51
4,303,826 12/1981 Ando ..... 219/10.51
4,532,398 7/1985 Henriksson ..... 219/10.79
4,874,916 10/1989 Burke ..... 219/10.75

FOREIGN PATENT DOCUMENTS 56-86789 7/1981 Japan .
58-39525 8/1983 Japan .

*Primary Examiner*—Philip H. Leung
*Attorney, Agent, or Firm*—Fish & Richardson

[57] ABSTRACT

A low frequency electromagnetic induction heater which applies a low voltage-high current performance transformer is disclosed. In the present heater, any space or vacancies between an induction coil and a metal heating pipe is excluded. This invention provides a high performance heater with the small temperature difference between the heating part and the material to be heated, high thermal efficiency, high reliability, high durability, and steady operation during a long period.

7 Claims, 5 Drawing Sheets

FIG. 4(A)
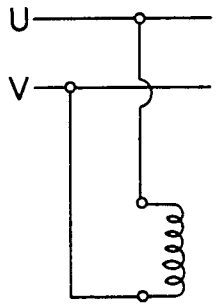
FIG. 4(B)
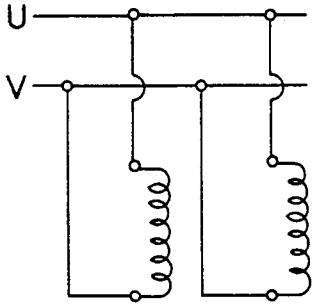
FIG. 4(D)
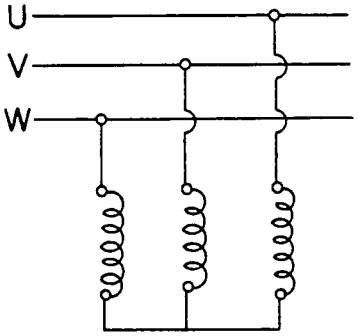
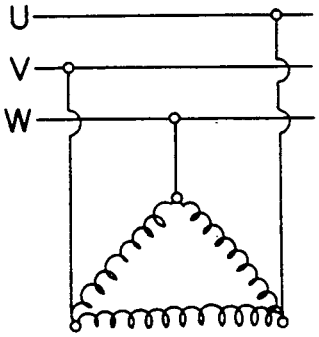
FIG. 4(E)
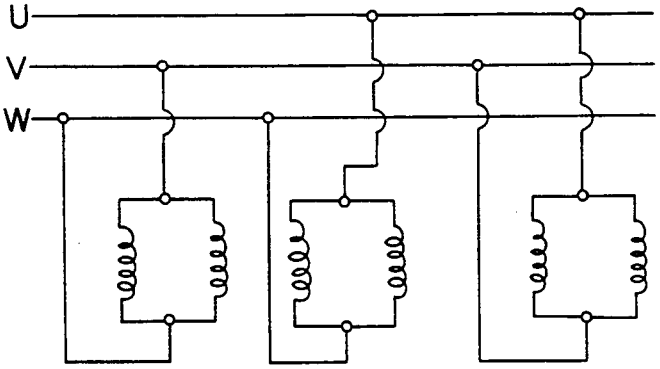
FIG. 4(C)
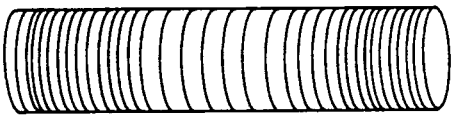
FIG. 5(A)
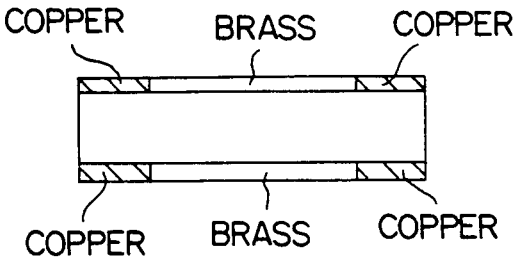
FIG. 5(B)

LOW-FREQUENCY ELECTROMAGNETIC INDUCTION HEATER

FIELD OF THE INVENTION

This invention relates to a low-frequency electromagnetic induction heater. In particular, this invention relates to a low-frequency electromagnetic induction heater wherein the temperature difference between the heater and the material to be heated is quite small.

BACKGROUND OF THE INVENTION

Generally, petroleum, coal and/or natural gas are burnt as heat sources for generation of steam and hot water in generating station and factories.

On the other hand, for small scale equipment, an electrical resistance heater may be utilized as a heat source from the point of convenience, although some small scale boilers still utilize petroleum and/or coal as heat sources.

There has been known an another type of electrical heater, that is, a low-frequency electromagnetic induction heater (Japanese unexamined utility model No. 56-86789, and Japanese examined patent No. 58-39525 etc.).

However, there have been serious problems in heating methods which utilize the burning of petroleum, coal and/or natural gas as heat sources. For example, a boiler of the type mentioned above has the problem that scale precipitates tightly to a heating pipe, therefore the thermal conductivity is lowered to cause inefficient heating and finally the heating pipe itself is destroyed due to an undesirably big temperature difference between heater part and the water to be heated. Currently, in order to avoid the occurrence of the above problem, the water to be supplied to a boiler and heated is required to be anti-scale treated before it is supplied by the use of chemicals which have effects in degassing de-oxigenation or maintaining the water in an alkaline range in pH. Further, currently heating system for whole building, which operates by circulating steam generated by burning of petroleum, coal and/or natural gas, are widely used, but they have the problem that the loss of energy is tremendous and the system cannot be regarded as an efficient heating system.

In the case where an electrical resistance heater is inserted and operated in water, water is locally and too strongly heated at high temeperature far from the boiling point of 100° C. Therefore, unless the heater having a sufficient interfacial conduction area is used, various problems unavoidably arise. The problems are summarized below.

(1) Unless the electric power is maintained below 2 watt per 1 $cm^2$, efficiency of heat conduction from the heater to water is decreased and the heater is destroyed.

(2) Because the required voltage amounts from 200 to 400 V, a very high voltage, sufficient isolation and insulation of heater from water must be provided. Usually an insulating material is a low thermally conductive material, so the heat conduction from heater to water is terribly impeded.

Low thermal conduction from heater to water causes over-heating of the heater, particularly of the heater surface, and when water molecule touch to the heater surface over-heated steam-explosion may occur to cause so called bumping, flashing, and/or forming phenomena. The occurrence of these phenomena can be fatally dangerous and give a fundamental problem that the thermal efficiency is drastically decreased.

A further problem for an electrical resistance heater is that it causes too big a temperature difference between the heating part and water as in the case where the heat source is gas burning. This too big temperature difference induces precipitation and adhesion of inorganic and organic solute components in water to the surface of heater, and because the precipitants behave as heat insulating materials, efficiency of thermal transfer is reduced, and therefore, boiling of water becomes an inefficient process. At the same time, heat release by heater becomes an inefficient process, and it may finally cause a suicidal accident, i.e., breaking of heater wire. In order to avoid this kind of accident, a current heater for water has large surface area, and very long heater is introduced into a water tank. However, still the above type of heater has problems that change of heater for cleaning is very annoying and operation reliability is low.

Further to the above, a fundamental and unimprovable problem for the conventional electrical resistance heaters is that they must have large buffer-water-tank in order to accomplish accurate temperature control of water, and therefore, they can not be miniaturized.

The low-frequency electromagnetic induction heaters disclosed in Japanese unexamined utility model No. 56-86789 or in Japanese examined patent No.58-39525 have problems, so that the design has not yet been optimized, the temperature difference between a heating element and a material to be heated is quite big, and thermal efficiency is not high enough.

SUMMARY OF THE INVENTION

It is the object of the present invention to solve all of the above problems in conventional heaters and provide a low-frequency electromagnetic induction heater wherein the temperature difference between a heating part and a material to be heated is small, operation reliability is high, and stable heating during a long period is realized by the following embodiments:

(1) employment of electromagnetic induction heating realized by application of a low voltage-large current short-circuit transformer, (2) eradication of any vacancy between induction coils and metal heating pipes.

In order to accomplish the above object, this invention includes a low-frequency electromagnetic induction heater comprising at least an iron core and an induction coil formed around said iron core, and a metal pipe formed around said iron core and induction coil, wherein a resinous mold is filled out between said induction coil and said surrounding metal pipe so that any substantial gap (vacancy) between surface of induction coil and surface of metal pipe in cross sectional view of said metal pipe is excluded.

It is preferable in this invention that the low-frequency current power source is in a commercial frequency range.

It is preferable in this invention that the metal pipe is an assembled pipe consisting of at least two layers of metal pipes.

It is preferable in this invention that the resinous molding compound is formed of a resin having high thermal resistivity.

It is preferable in this invention that an electric power supplied to the metal pipe is larger than 3 watts per 1 $cm^2$ of the surface of the metal pipe.

BRIEF DESCRIPTION OF THE DRAWINGS

This invention will now be described in detail with reference to the following drawings.

FIGS. 4(A), 4(B), 4(C), 4(D) and 4(E) show examples of connection diagrams in accordance with this invention.

FIGS. 5(A) and 5(B) show an embodiment in this invention.

DETAILED DESCRIPTION OF THE INVENTION

The invention will now be described in detail with reference to the drawings.

Figure 1A:
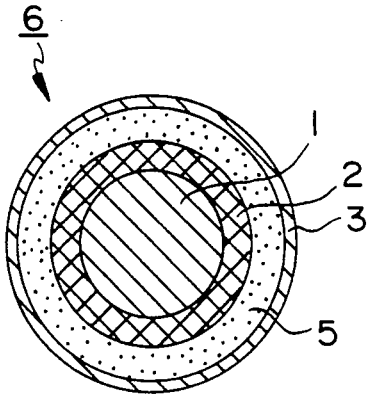
FIGS. 1(A) and 1(B) show a cross sectional view of an embodiment in this invention.

FIG. 1(A) shows a cross sectional view of an embodiment of this invention. A low-frequency electromagnetic induction heater 6 has an iron core 1 and an induction coil 2 formed around said iron core 1, and metal pipe 3 formed around said iron core 1 and induction coil 2, wherein a resinous mold 5 is filled out between said induction coil 2 and said surrounding metal pipe 3 so that any substantial gap (vacancy) between a surface of induction coil 2 and a surface of metal pipe 3 in cross sectional view of said metal pipe 3 is excluded.

Figure 1B:
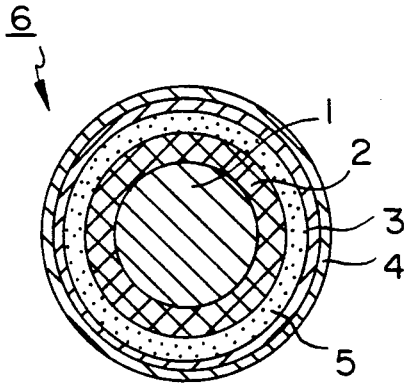

FIG. 1(B) shows another cross sectional view of an embodiment of this invention. A low-frequency electromagnetic induction heater 6 has an iron core 1 and an induction coil 2 formed around said iron core 1, and metal pipes 3 and 4 formed around said iron core 1 and induction coil 2, wherein a resinous mold 5 is filled out between said induction coil 2 and said surrounding metal pipe 3 so that any substantial gap (vacancy) between a surface of induction coil 2 and a surface of metal pipe 4 in cross sectional view of said metal pipes 3 and 4 is excluded.

The first special feature of the present invention to be described is that a resinous mold 5 is filled out between an induction coil 2 and a surrounding metal pipe 3. The presence of the resinous mold 5 markedly increases efficiency of heating. Taking the example where water is going to be boiled, temperature of the inside of an induction coil reaches about 500° C. in the absence of the resinous mold, whereas in the presence of the resinous mold the temperature only reaches about 130° C. Therefore, the presence of the resinous mold serves an important role in maintaining the small temperature difference between a heating element and a material to be heated.

The second special feature of the present invention to be described is that any substantial gap (vacancy) between a surface of induction coil 2 and a surface of metal pipe 4 is excluded. In an example where two kinds of metal pipes are used, any substantial gap (vacancy) between a pipe 3 and a pipe 4 is excluded. Exclusion of any vacancy or space is effective to improve thermal conduction, and, therefore, thermal efficiency. Resins used as a resinous mold in the above description are any resins which can be molded. For example, epoxy resins, acrylic resins, vinyl resins, phenol resins, silicone resins, polyester resins, and so on. More preferable resins are thermosetting resins having thermal resistance above 100° C. The molding or casting methods may be any method known so far, for example a vacuum casting, conpression casting, and flow-in casting.

Additionally, it is pointed out here that the presence of the resin molded between wire-coilings of induction coil 2 is especially preferable. In the case where the resin exists between wire-coilings of induction coils 2, the heat evolved inside the wire is effectively removed.

Resinous mold should be;

(1) thermally conductive (i.e. compound filler of Aluminium particle), (2) electrically insulating, (3) thermally resistant.

Any material which meets with above requirements can be used as a molding material. Note that, in this meaning the material should not be limited to resins.

The heater 6 as the embodiment described above comprises an iron core, an induction coil, and a metal pipe of a vertical or horizontal type.

Figure 2A:
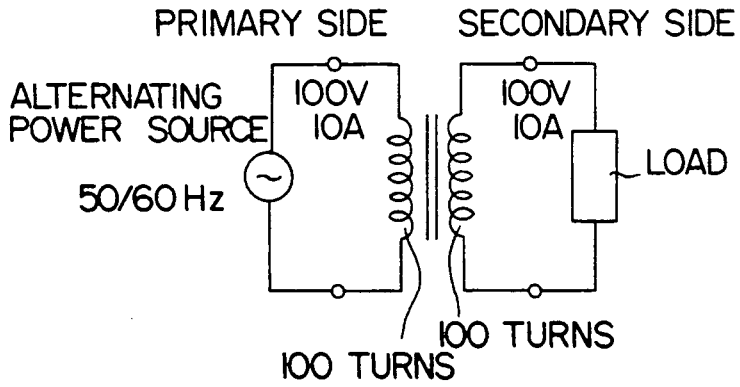
Figure 2B:
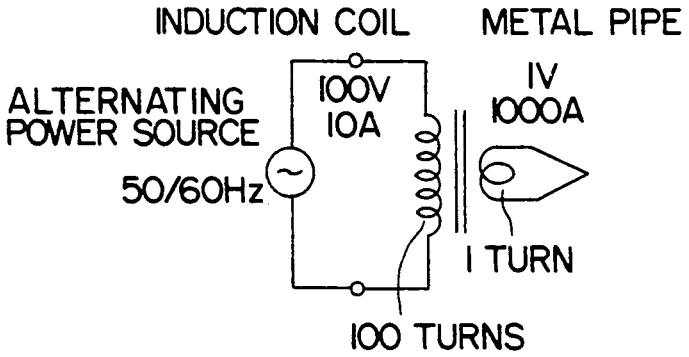

Next, the principle of heating in the present invention will be explained with the aid of FIG. 2. FIG. 2A shows a schematic of a transformer. In the case where 10 A of an alternating current flows through the primary induction coil of 100 turns by supplying 100 V of a commercial frequency alternating power source at 50 Hz or of 60 Hz, theoretically, 10 A of an alternating induction current in 100 V at 50 Hz or of 60 Hz flows through the secondary induction coil of 100 turns in the opposite direction. In the case shown in FIG. 2B where the number of turns of the secondary induction coil is just 1, an alternating current flow of 10 A induces flow of 1000 A of an alternating induction current of just 1 V at 50 Hz or of 60 Hz through the secondary induction coil. That is to say, now it becomes the transformer of low voltage and high current performance. In this invention, this low voltage and high current performance transformer principle is fully and effectively utilized by employing an induction coil on the primary side and a metal pipe on the secondary side. Any electro-conductive metal pipe can be used as a metal pipe in the secondary side in this invention. For example, it can be cupreous or iron. As shown in FIG. 2B, an induction current which flows through a metal pipe (for example, a cupreous pipe) is very high, and this high current is very effective in heating. That is, flow of a high alternating current induces evolution of joule heat by a short-circuit current, and this mechanism of heat evolution is very efficient as is generally anticipated. In this meaning, a high voltage is not effective and not necessary in heating. Therefore, it should be emphasized that the important point in this invention is that a high current which is truly effective in heating is specifically utillized instead of high voltage. The voltage of the current passing through the secondary cupreous pipe is so low that a user never receives an electrical shock even he touches the pipe, so it is very safe. In addition, according to the principle utilized in the present invention, the heating area is necessarily very wide because of the employment of the specific configuration in which a metal pipe is constructed on the outside of an induction coil. And yet, electric power per unit area of the heating pipe can be higher than the existing heaters. Therefore, the heater in the present invention can be well operated with a supplied electric power higher than 3 $W/_{cm}{}^2$ or 4 $W/_{cm}{}^2$ which usually can not be applied to the existing heaters. The reason why such high electric power can be supplied specifically to the heater in the present invention is that because the heating area is so wide, the temperature difference $\Delta t$ between the heater and the material to be heated can be kept to small.

Figure 3:
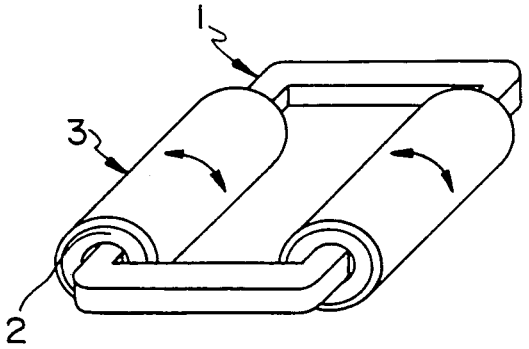
FIGS. 2(A) and 2(B) and FIG. 3 show a principal mode of operation of this invention.

FIG. 3 shows a model mode of the heating part in this invention. The heating part comprises an iron core 1 and an induction coil 2 formed around the iron core, and a metal pipe (a heating pipe) formed around these. When an alternating current in a commercial frequency range is passing through an induction coil 2, a metal pipe 3 evolves heat. The heat thus evolved is, then, transferred from the metal pipe to a material, for example water, to be heated existing in the outside of the metal pipe. The material is heated up in this manner.

The metal pipe shown in FIG. 1(B) is composed of of two combined metal pipes 3 and 4, but, the usable pipe in the pesent invention is not restricted to the above embodiment. A metal pipe shown in FIG. 1(A) of single metal component (for example, a pipe made from stainless steel, or from copper) as well as a combined pipe composed of more than two metal pipes, which is made so as not to have any vacancy in between these pipes, can be used in the present invention. An example of a combined pipe is the one having a cupreous pipe as an inside pipe 3 and a stainless steel pipe as an out side pipe 4. The copper inside pipe is used in order to improve the heat conduction, and the stainless steel outside pipe is used to have a high stability and a high corrosion resistance. That is, a type of a metal pipe can be chosen and used on depending the individual occasions or purposes. As a method of combining (cladding) these pipes, any known method, for examples, an explosion-adhesion method or inside pipe enlargement method, can be used. In another embodiment of the present invention, a metal pipe may be coated with a resin (a resinous lining). For example, a metal pipe of a plain copper pipe whose surface is covered with a fluorine-containing polymer (for example, "Teflon (Resistered)" made by E.I. DU PONT DE NEMOURS & COMPANY (INC.)) lining can be usefully employed.

A low-frequency alternating current power source in a commercial frequency range is supplied to the heaters in this invention. The reason why the low-frequency commercial current source is used is that the source is widely available and, therefore, economically most preferable.

Now, a preferred embodiment in the present invention is explained. FIG. 4 shows a concrete example comprising from one to six heating metal pipes and an input electric power source of voltage from 100 to 440 V in 50/60 Hz. FIG. 4(A) shows an example of a connection diagram for the case where a single-phase electric power source is supplied and the number of metal pipes is just one. FIG. 4(B) shows an another example of a connection diagram for the case where a single-phase electric power source is supplied and the number of metal pipes is two. And, FIG. 4 from (C) to (E) show examples of connection diagrams for the case where a three-phase electric power source is supplied. Other electrical connection can be, indeed, usable if it meets with the scope of the present invention.

The preferable diameter of the metal pipe in the present invention ranges from 70 to 200 $_{mm}$. If the diameter is too small, then a magnetic flux passes through not only the inside but also the outside of the pipe. This makes the loss of magnetic flux large, therefore, it should be avoided. A preferable electric power capacity ranges from 1 to 50 kw, but it is not restricted within this range. Next, a preferable length of the metal pipe ranges from 10 $_{cm}$ to 1 $_{m}$, but it is not restricted within this range.

A concrete example which is suitably applied to improve a heater having a big and inhomogeneous temperature distribution is shown in FIG. 5. FIG. 5(A) shows an example of coil whose coiling density is changed from the ends to the middle, namely, the middle part is densely coiled and the end parts are roughly coiled. This type of coil is very useful in the cases where much heat release is required or the temperature of the end parts tends to go down by the supply of a material to be heated from the end-side. Inversely, a coil having the dense coiling in the middle part can be effectively used in the case where the temperature of the middle part tends to decrease naturally. FIG. 5(B) explains the method effective in improving the temperature inhomogeneity, in which different kinds of metal are used in a pipe depending on the distance from the end. In order to heat up the surrounding material more efficiently, copper is used in the end parts and brass is used in the middle part.

FIG. 6 shows other embodiments of the present invention. FIG. 6(A) and (B), or (C) and (D) show heaters operating with single-phase or three-phase electric power sources, respectively. Heating element 6 used here is the same one shown in FIG. 1. 7 means the heating zone, 8 an entrance for a fluid (for example, water), 9 an exit, 10 a pump. In FIG. 6, a heater 6 is constructed in a vertical type, but a horizontal type works as well.

Figure 7:
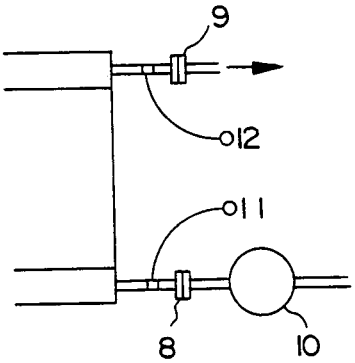
Figure 8:
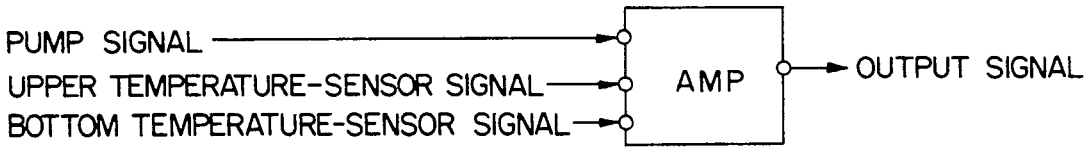
Figure 9:
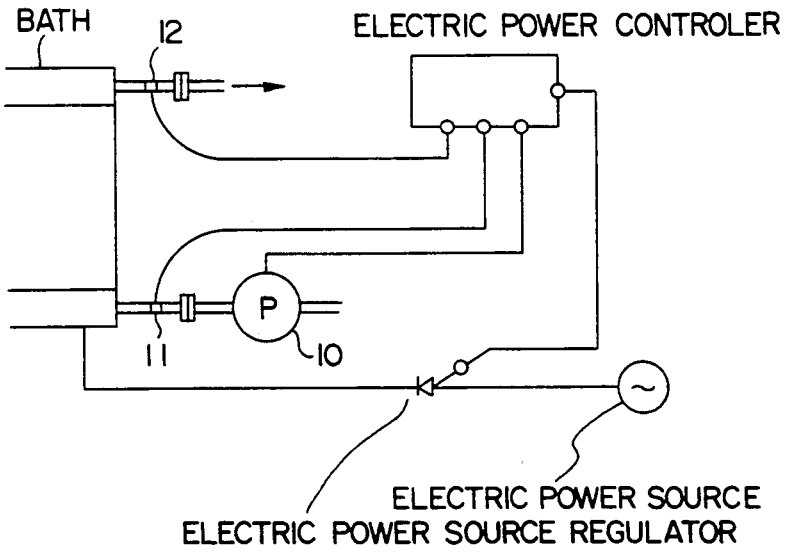

FIG. 7 shows an embodiment which has an upper temperature-sensor 11 at the entrance part of the jacket and a bottom temperature-sensor 12 at the exit part of a fluid. The signals obtained by these sensors and the signal concerned with the mass of flow detected by a flow-meter are sent to an electric power controller, as are shown in FIGS. 8 and 9. The supplied electric power is regulated with reference to the product of the temperature difference between the entering and the exiting fluid and the mass of fluid flow. That is, the electric power controller calculates the excess or the insufficient amounts of heat in Kcal unit to the setting fluid temperature, and decreases or increases the electric power just by the calculated amount, automatically. In the electric power control system mentioned above, the calculation circuit can momentarily convert the excess or the insufficient amounts of heat in Kcal unit to KW unit, and controls the voltage supplied to the primary coil, thus, the accurately temperature controlled fluid can be obtained. Here, the signal of the mass flow may be any signal, for example the rotational frequency of the pump or the flow signal itself in the case flowmeter is used. The regulation of the electric power is very accurate and easy, because the supplying electric power in KW unit and the excess or the insufficient amounts of heat in Kcal unit is in a simple linear relationship.

The voltage induced in the metal pipe of the present invention ranges from 1 V to 0.3 V, and it is very low, lower than a commercial dry cell of 1.5 V. Thus, a user is very safe. In addition, the heater can be used even under high humidity. Further, an induction coil can be made of cupper copper wire, aluminum wire, or any conductive metal wires. The life and the durability of the heater in the present invention are significantly extended by the vacuum injection molding of the resin. Because the area of heat transfer is wide, the temperature of the heating part can be as low as 100° C. or 130°

C. in the case of the fluid to be heated is water, precipitation and pile up of calcium, salt, or scale are prevented.

Examples of effective applications of the heater in the present invention are a heater for the oil used in heating foods (a fryer), a heater for water used in heating foods (a steam generator), a heater for a dish washer which requires a hot water in about 80° C., a heater for cooking below 100° C. (specifically, it is useful in making cooked foods like NIMONO which requires gentle and prolonged heating), a heater for an organic solvent in a cleaner, a heater for a bath (rewarming), a heater for a gas or heavy oil, a heater in a boiler (particularly for the local heating purpose), and etc. The present heater can be widely used because it has the great merits that it is highly safe and its thermal efficiency is very high.

This invention will now be illustrated with reference to the following examples that no means limit the scope of the invention.

EXAMPLE 1

Figure 6A:
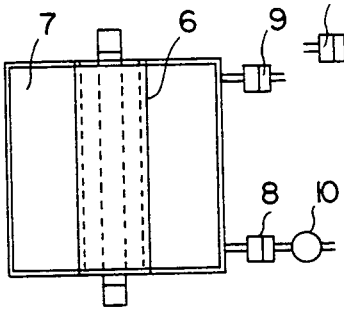
FIGS. 6(A), 6(B), 6(C) and 6(D), 7, 8 and 9 show still other embodiments of this invention.
Figure 6C:
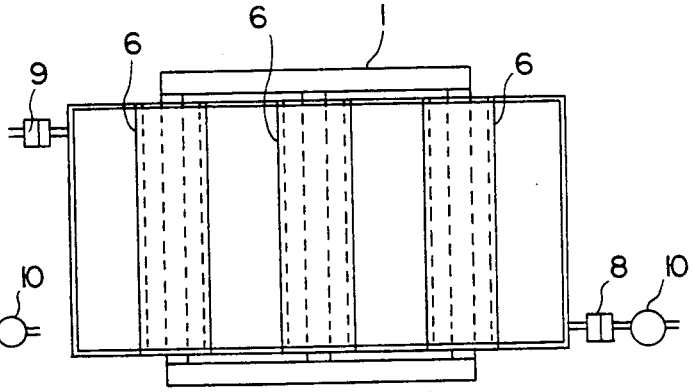
Figure 6B:
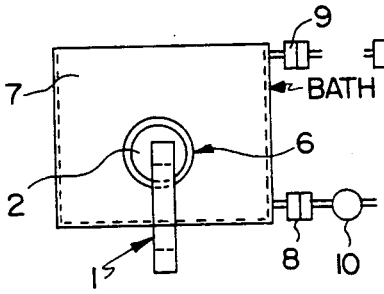

An electromagnetic induction heater whose cross sectional view is shown in FIG. 1(B) is constructed, as shown in FIGS. 6(A) and 6(B), and 7. An iron core is a multi-layered silicon steel plates, an induction coil is made from copper wire, a metal pipe is a combined type having a copper pipe inside and a stainless pipe outside. Any vacancy or space is excluded between the induction coil and the pipe by filling it full with an epoxy resin through vacuum injection molding. The heater is used in heating 1,1,1-trichloroethane solvent in the IC (integrated circuit; IC chip) cleaner. It has turned out that the heater in the present invention can be operated at electric power levels of 10 KW at the initial stage and of 4 KW at the stationary working stage, whereas the usual type of cleaner with an electric resistance heater requires a electric power of 20 KW at the initial stage and of 10 to 12 KW at the stationary working stage. It has also turned out that precipitation of scales and dust onto a heating pipe is considerably suppressed and the life of the heater is prolonged, because the present heater works at relatively low temperature compared with that for the conventional heaters.

EXAMPLE 2

Figure 6D:
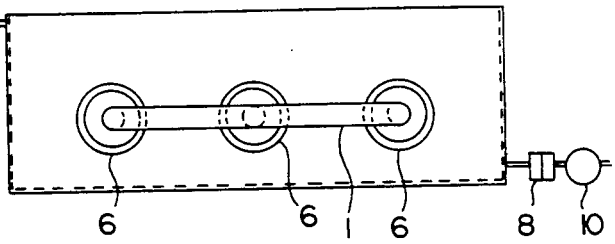

An electromagnetic induction water heater comprising a heater shown in FIG. 1(A) is constructed, as shown in FIGS. 6(C) and 6(D), and 7. Three copper pipes whose diameter is 90 mm and the length is 260 mm are placed in a bath. Any vacancy or space is excluded between the induction coil and the pipe by filling it full with an epoxy resin through vacuum injection molding. The supplied electric power per unit area of the heating pipe has been controlled to be 4.5 W, that is, the power density is 4.5 W/ $cm^2$. Water is steadily flowed through the bath with the water flow rate of 15 liters/min. The electric power source is the three-phase alternating current source of 200 V, 25 A, in 60 Hz. It is recognized that the present water heater can continuously supply hot water at a well regulated temperature within 80°±1° C. The voltage and the current induced in the secondary copper pipes have been measured during the operation, these turned out to be 0.5 V and about 10000 A, respectively.

EXAMPLE 3

An electromagnetic induction water heater comprising a heater shown in FIG. 1(A) is constructed, as shown in FIGS. 6(C) and 6(D), and 8 and 9. Three of copper pipes whose diameter is 90 mm and the length is 260 mm are placed in a bath. Any vacancy or space is excluded between the induction coil and the pipe by fulfilling an epoxy resin through a vacuum injection molding. The supplied electric power par unit area of the heating pipe has been controlled to be 3.0 W, that is, the power density is 3.0 W/ $cm^2$. Water is steadily flowed through the bath with the water flow rate of 20 liters/min. The electric power source is the three-phase alternating current source of 200 V, 25 A, in 60 Hz. The temperature of the outcoming hot water and the flow rate of water have been set to be 65°±1° C. and 20 liters/min., respectively. The hot water of the setting temperature has been obtained with this apparatus irrespective of the fluctuations of the temperature of the water in feed and the mass of water flow, during the long operational period. In addition, the heater is very easy for cleaning because of its simple inside structure of the bath. The voltage and the current induced in the secondary copper pipe have been measured during the operation, these turned out to be 0.5 V and about 10000 A, respectively.

I claim:

1. A low-frequency electromagnetic heater, comprising an iron core, an induction coil formed around the iron core and a metal pipe disposed around the iron core and the induction coil, thereby defining a space between the pipe and the iron core wherein the space is filled with a thermally conductive resinous molding compound.

2. A low-frequency electromagnetic induction heater as set forth in claim 1, which operates with the low-frequency current power source in a commercial frequency range.

3. A low-frequency electromagnetic induction heater as set forth in claim 1, wherein the metal pipe is an assembled pipe comprising at least two layers of metal pipes.

4. A low-frequency electromagnetic induction heater as set forth in claim 1, wherein the resinous molding compound is formed of a resin having high thermal resistivity.

5. A low-frequency electromagnetic induction heater as set forth in claim 1, further comprising means for supplying electric power indirectly to the metal pipe at a rate larger than 3 watts per $cm^2$ of the surface of the metal pipe.

6. A low-frequency electromagnetic induction heater as set forth in claim 1, wherein the resinous molding compound is selected from the group consisting of epoxy resins, acrylic resins, vinyl resins, phenol resins, silicone resins and polyester resins.

7. A low-frequency electromagnetic heater, comprising a ferromagnetic core, an induction coil formed around the core and a metal pipe disposed around the iron core and the induction coil and defining a space between the pipe and the core, wherein the space is filled with a thermally conductive resinous molding compound.

* * * * *